United States Patent [19]

Weil

[11] 3,946,855

[45] Mar. 30, 1976

[54] DEVICE FOR DELIVERING ITEMS AT CERTAIN INTERVALS

[75] Inventor: Willi Weil, Hamburg, Germany

[73] Assignee: Lever Brothers Company, New York, N.Y.

[22] Filed: June 18, 1974

[21] Appl. No.: 480,348

[30] Foreign Application Priority Data

June 18, 1973 Germany ..... 2330925

[52] U.S. Cl. ..... 198/34; 198/76; 198/127 R

[51] Int. Cl.[2] ..... B65G 47/26

[58] Field of Search ..... 198/34, 127 R, 110, 76, 198/127 E; 53/59

[56] References Cited

UNITED STATES PATENTS

| | | | |
|---|---|---|---|
| 1,725,740 | 8/1929 | Schulte | 198/127 E |
| 2,701,049 | 2/1955 | Kendall et al. | 198/110 X |
| 3,155,221 | 11/1964 | Griner | 198/34 |
| 3,382,964 | 5/1968 | Bonhoff et al. | 198/127 R |
| 3,424,293 | 1/1969 | Deutschlander | 198/34 |
| 3,621,975 | 11/1971 | Vilen | 198/34 |
| 3,721,330 | 3/1973 | Crawford et al. | 198/34 |

*Primary Examiner*—Robert J. Spar
*Assistant Examiner*—James M. Slattery
*Attorney, Agent, or Firm*—Arnold Grant

[57] ABSTRACT

A device for delivering items such as stacks of cheese slices from an intermittently operating feed device to a rapidly and regularly operating packaging machine. A series of rollers feed the items regularly at lower speed to the packaging device after having received these items at higher speed from the intermittent feed device. A control unit controls the speeds of individual rollers to cause their speeds to change in a predetermined sequence from the low speed to the high speed in a way which minimises spacing between successive articles.

2 Claims, 3 Drawing Figures

FIG. 2

DEVICE FOR DELIVERING ITEMS AT CERTAIN INTERVALS

The invention relates to a device for conveying articles requiring careful handling, for example cheese slices, which have to be conveyed quickly from an intermittently working discharge device to a rapidly and regularly operating packaging machine. Machines of the form-fill-seal type, into which the articles have to be moved at a steady speed and following each other closely are of this type.

Form-fill-seal machines, as is well known, work according to a method in which one or two webs of a moving material are shaped into a moving tube, a transverse heat-sealing operation is carried out, the article to be packed is placed into the pocket formed in this way, and a further heat-sealing operation is subsequently carried out so as to close the first filled pocket by sealing it and forming a subsequent pocket. In some cases this type of machine is designed for horizontal forming, whilst in others the method of operation is vertical.

The present invention relates to an apparatus which is particularly suited for the delivery of articles to the above-mentioned horizontal type of machine.

Where the delivery or feed device, for example a cheese slicing and stacking machine, works intermittently an accumulator conveyor can be used which, by means of a speed adjustment device controlled by a photo-electric cell, enables a row or queue of articles to accumulate, which move at a constant speed, the articles at the end of the queue being fed in arbitrarily at a higher speed. A machine of this type is known from U.S. Pat. No. 3,187,878; with this known machine the articles must, however, be conveyed at the end of the system to a second conveyor moving at right angles beneath the first one whilst maintaining wide spaces between the articles.

This method is not suitable for cheese slices, as the fast change of direction could upset the stacks, nor for stacks which have to be conveyed to a form-fill-seal machine direct without any intervening steps being taken.

A solution to this problem has been suggested in published Belgian Patent No. 767,497 of which applicant is inventor. In this Belgian patent (corresponding to Canadian Pat. No. 934,964) the articles, which have been assembled to form a queue by means of a series of accumulation conveyors, are arranged to be fed out intermittently by means of a series of rollers, starting at the front of the row or queue. Each roller has its own driving motor with two operating speeds and its own photocell detector system which controls the speed of the roller in question and thus the extent to which the articles are moved forward by the system. The latter is synchronised with the form-fill-seal machine and enables the clearance or gap between successive articles to be reduced.

In practice, however, the use of a separate photocell for each roller has proved to be unduly complex where the size of the different slices was much the same, so that the equipment was more expensive and less reliable than was desirable. In particular the question of reliability proved to be a problem, as a fault in just one of the photocells would lead to the unsatisfactory performance of the entire equipment.

It has meanwhile been found that, since the sequence of operation of the successive rollers is always the same when two successive articles are fed through, it is not necessary for each roller to have a photocell control of its own. The invention therefore provides for a device for delivering successive articles to a packaging machine comprising a series of rollers each of which is driven by its own motor and arranged so that an article is supported and conveyed jointly by a number of successive rollers as it passes through the device, and control means for the control of each roller individually to effect a first stage of transport in the course of which the article is fed into the device and taken to a synchronisation position at a high speed, and to effect a second stage of transport in the course of which the article is fed out of the device at a low speed in response to a synchronisation signal from the packaging machine, said control means incorporating a timing unit which is arranged to control the speeds of the rollers in such a way that an article is moved out from the synchronisation position at the low speed and subsequently to change the speeds of successive rollers over from the low speed to the high speed at subsequent and predetermined time intervals after activation of the control means, so as to enable a subsequent article to be moved into the synchronisation position at the high speed, whilst the preceding article is still being fed out of the device at the low speed.

The timing device can control the times of operation and speeds of the rollers electronically or electromechanically. To this end RC timing circuitry or rotary-cam actuated switches can be used. The device is preferably used in conjunction with a horizontal form-fill-seal machine, and for conveying the articles away from the series of rollers at intervals to coincide with the strokes of the form-fill-seal machine.

Preferably the device will comprise a series of belt conveyors for accumulating the articles ready for feeding them to the series of rollers.

An embodiment of the invention is described below by way of example with reference to the diagrams, in which FIG. 1 is a side elevation of a conveyor according to the invention;

Figure 1:
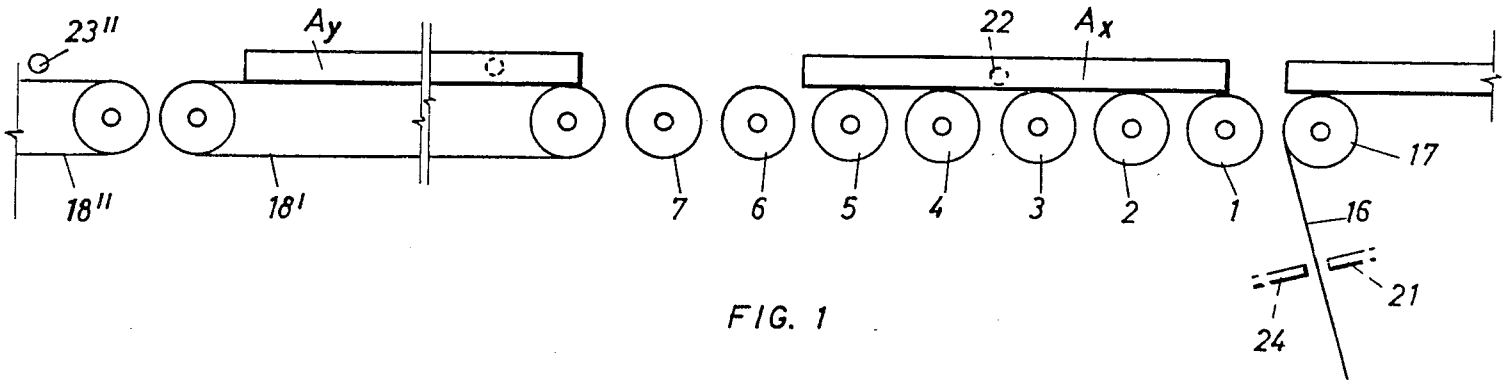
Figure 2:
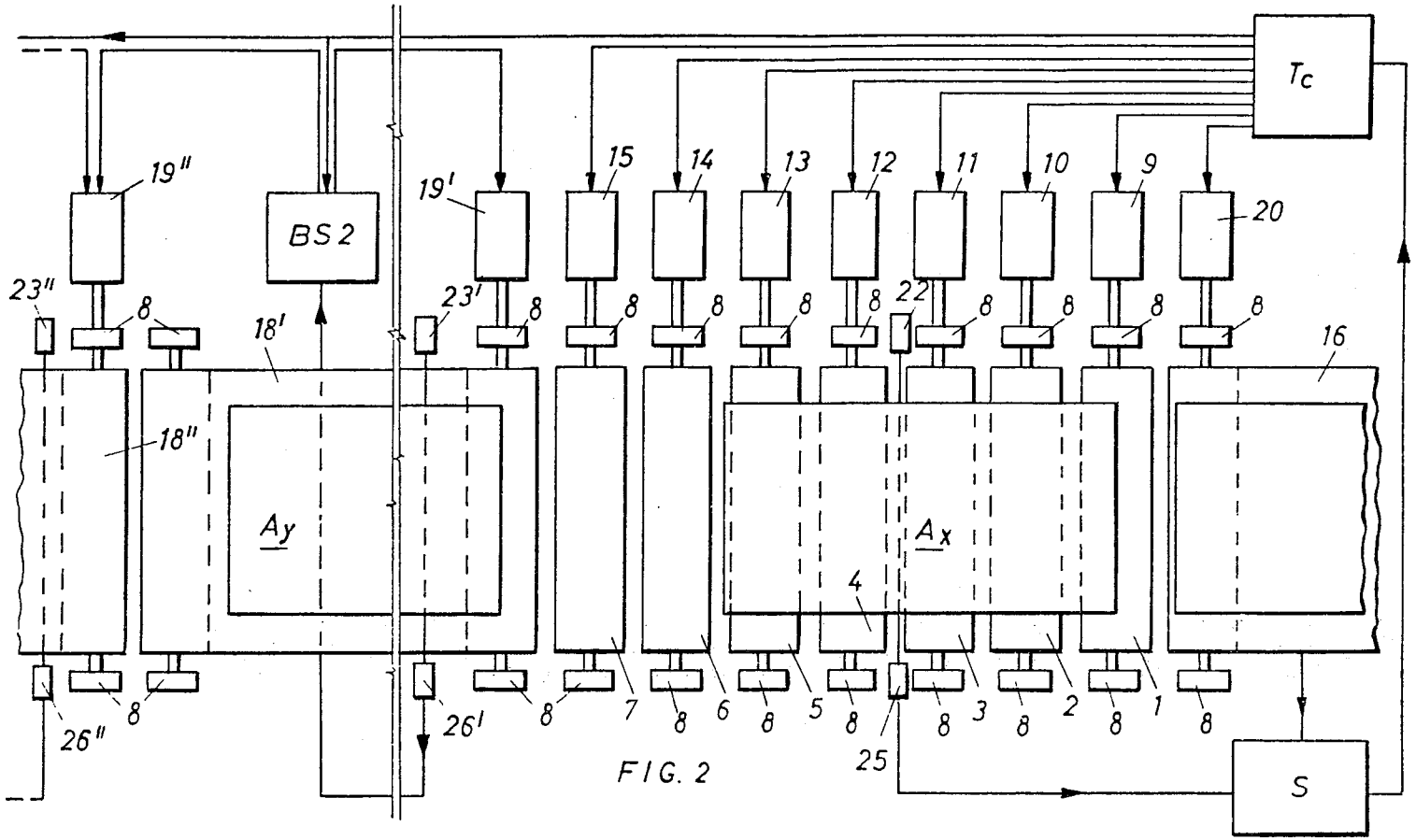
FIG. 2 is a plan view of the conveyor including a block circuit diagram.

The device comprises a series of rollers 1, 2, 3, 4, 5, 6, 7, each carried in bearings 8 and driven by separate motors, 9, 10, 11, 12, 13, 14, 15. The rollers lead on to a web of packaging material 16 carried on a roller 17 and forming the first stage of a horizontal form-fill-seal packaging machine (the remainder of this form-fill-seal machine is conventional and of well known form such as is described in Modern Packaging Encyclopaedia July 1971 issue at pages 448 to 456.)

Leading on to the rollers (1 to 7) are a series of belt conveyors 18 of which the first 18' is shown in full and the second 18'' is shown fragmented. Any number of further belt conveyors similar to those shown may be provided in sequence back up the line.

Each belt conveyor is carried on rollers mounted in bearings 8 and has its own separate driving motor 19', 19'' etc.

The motor for the individual rollers (1 – 7) each have either one or two operating speeds, fast and/or slow, the belt conveyor motors 19', 19'' etc. each having the higher operating speed while the packaging film motor has the lower speed. In each case the motors, except the motor of the packaging machine, are step wound so as to be able to change in speed between the stationary condition and the low and high operating speeds at a constant rate of acceleration or deceleration. In principle other motors are also possible, e.g. direct-current motors, although step-wound motors are preferred as they are readily controlled by altering the supply frequency.

In the diagram the web 16 is shown as being driven by a roller 17 mounted in bearings 8 and a driving motor 20. In practice the driving arrangements for the web 16 will be determined by the particular form-fill-seal machine used, and in consequence may differ slightly from that shown.

Having described the mechanics of the conveyor, the control means will now be described.

Separate light beam sources 21, 22, 23′, 23″, are provided to direct beams of light across the photocell detectors 24, 25, 26′, 26″.

The light source and detector combination 21, 24 is the conventional one supplied with the form-fill-seal machine to react to a synchronisation mark on the web 16. The source and detector 22, 25 is located so that the beam is broken by the presence of an article, generally a cheese slice or stack of slices, cuting across the beam and carried on the rollers 1 to 7.

A source and detector 23′, 26′ is provided for the belt conveyor 18′ and again reacts to the presence of an article cutting across the beam and carried by the conveyor 18′. Similar source and detector combinations 23″, 26″ etc. are provided for each belt conveyor 18″ etc. further back up the line.

The outputs from each of the photocell detectors 24, 25, are fed to synchronisation unit S, and synchronisation signals dependent on the passage of a synchronisation mark on the web, and on the presence or absence of an article on the set of rollers 1 to 7 are then fed to a timing and control unit TC.

The output of the photocell 26′ is fed to a conveyor-synchronisation unit BSI and from there both to the driving motor 19′ of the appropriate conveyor and to the driving motor 19″ of the preceding belt conveyor. In the same way the photocell system of the belt conveyor controls the appropriate motor and the motor of the preceding conveyor for each of the belt conveyors situated further back up the line. Each motor 19 is designed and fitted so as to enable it to convey at high speed and to stop if an article cuts across the appropriate photocell beam, and when the subsequent path is not free, or until it is free. Each belt or conveyor-synchronisation unit is provided with the usual amplifier and circuitry to enable this method of operation to be carried out. The articles are thus taken to the rollers 1 to 7 at high speed, are halted and in this way form an accumulation queue when the path to the point of discharge from the system via the rollers 1 to 7 is not free.

The timing and control unit TC has separate connections to each of the motors 20, 9, 10, 11, 12, 13, 14, 15 (and to the synchronisation unit BSI) and sends signals to each of these motors at appropriate times to start them, stop them and to change their speed.

The output of the photocell 25 is taken to the control mechanism of the motors 20 and 19′ via the synchronisation unit S and the timing and control unit TC by means of the usual ampliier and circuitry which corresponds to those of the belt synchronisation unit BSI. In this way the motor 20 is started up to move the web 16 at a constant, low speed when an article cuts across the beam between the source and the detector 22 or 25, that is to say, when an article is in the correct position for conveying it into the form-fill-seal machine for packaging. The motor 19′ is controlled so as to enable it to stop when an article crosses the appropriate beam between the source and the detector 23′ or 26′, unless such a stop is prevented by a starting signal from the timing and control unit TC via the conveyor-synchronisation unit BSI.

When the web moves a combination of the light source and the photocell detector 21, 24 reacts to a synchronisation mark at the appropriate time.

The output from 21, 24 is then fed via the synchronisation box to the timing and control unit to cause each of the motors 9, 10, 11, 12, 13, 14, 15, 19′ to start up at appropriate speeds and after appropriate time intervals. Thus each of the rollers 1 to 7 and the first conveyor belt 18′ will each start up in a controlled manner, and cause successive articles to be fed up to the synchronisation position and from there onto the web 16.

Figure 3:
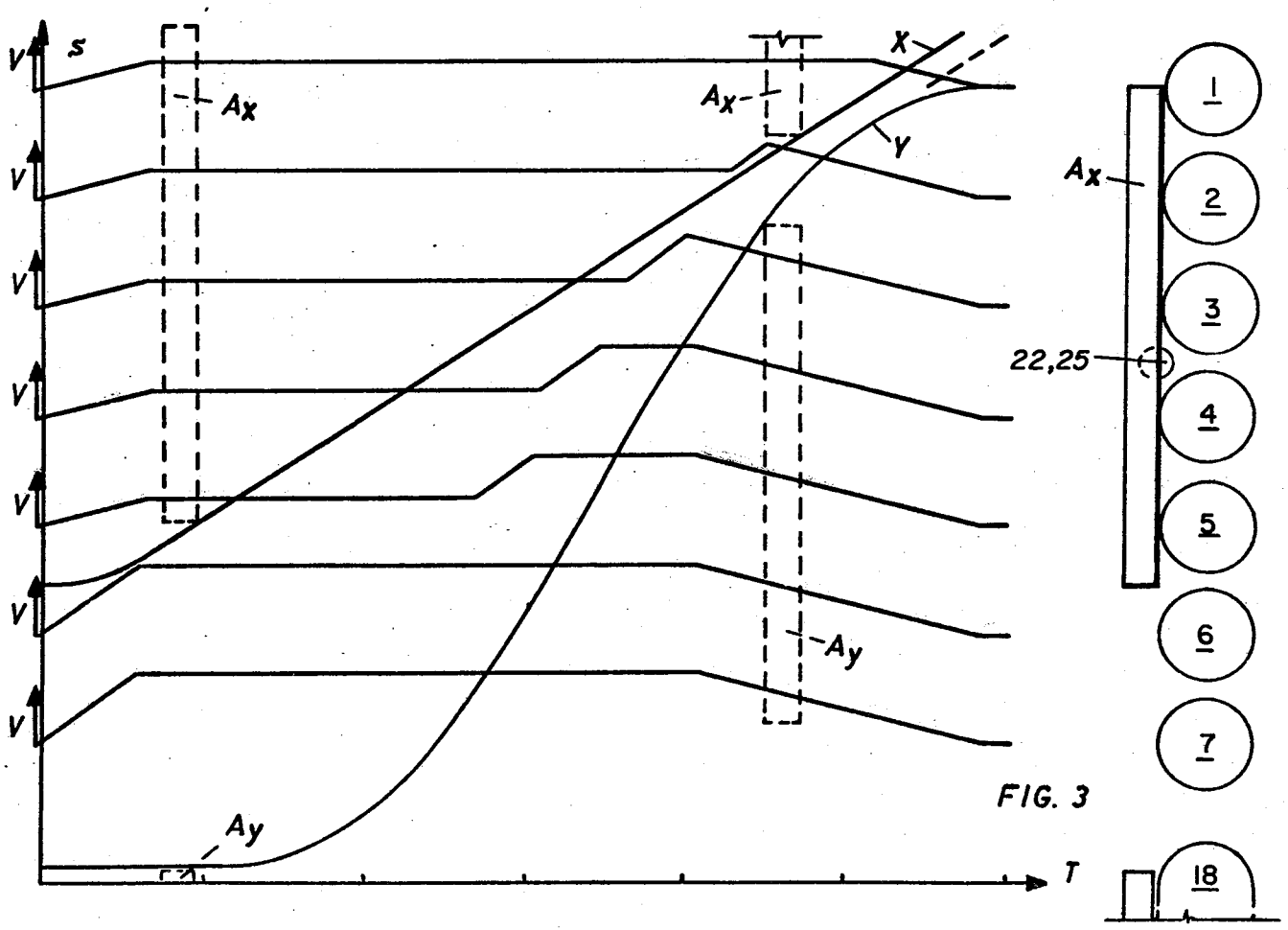
FIG. 3 is a complex graph showing the velocities of the rollers while articles are conveyed.

The manner of this will be described with reference to FIG. 3. FIG. 3 shows graphs of the distances of movement of articles Ax and Ay against time T. Graph X indicates the movement of the trailing end of article Ax, while graph Y shows the movement of the leading end of article Ay. The graphs are shown in this way to indicate how closely the two articles can appproach without one touching the other, i.e. the point where the two curves come closest.

Shown to the right of FIG. 3 and aligned with and to the same scale as the distance scales is an enlarged section from FIG. 1 indicating the position of each of the rollers 1 to 7, the light beam 22, 25, between the source and the detector and the article Ax when at the synchronisation position. Opposite each of the rollers are velocity profiles of each respective roller, using the same time scale but velocity scales V instead of the distances scales.

From the composite graphical diagram of FIG. 3 the velocity of each roller in relation to the position of the article Ax or Ay can be obtained. Two examples are shown dotted in the Figure, showing the relative positions of Ax and Ay at different times in the cycle and it will be noted that in each case the article is supported by rollers which are all travelling at the same velocity.

By switching and time delay circuitry in the timing and control unit TC the velocity profiles for each of the rollers 1 to 7 are achieved. Solid state circuitry of a conventional nature using RC time delay circuits, amplification and relays is used to achieve this, although the same can be achieved mechanically by rotary cam actuated switches.

The roller 1 has a velocity profile taking it immediately at constant acceleration to the slow speed and then at the end of the cycle returns at constant deceleration to the stop condition. The roller 2 has a similar initial profile but near the end of the cycle changes to a higher speed and finally decelerates at a constant rate to the stop condition.

Rollers 3, 4 and 5 have similar profiles but switch over to the faster speed at progressively earlier times in the time cycle, while rollers 6 and 7 operate only at the higher speed.

The reason for the changeover in speed is so that the leading rollers 1 to 5 can be feeding out the leading article Ax at the lower speed, while the rearmost rollers 7, 6 and then progressively 5 back to 2 can feed the next article in at the higher speed without subjecting the articles to sudden changes of speed or the risk of being supported by rollers travelling at different speeds, all of which would cause slipping and unsatisfactory operation.

In operation articles are fed on to the input of the line of belt conveyors 18 and are successively fed at the higher conveyor speed onto the rollers 2 to 7 until the position is reached where the leading article Ax cuts the beam between the source and the detector 22, 25. The output of the detector 25 then, via units S and TC causes the rollers to slow down at a constant deceleration to the stop condition and also causes the web 16 to start moving. Thereafter steady state conditions should be reached where the web travels continuously at constant speed.

While the leading article Ax is reaching the position shown in the Figures, the next following article Ay will eventually cross the beam 23', 26 between the source and the detector and cause the conveyor 18' to stop. Successive articles will follow behind and accumulate as they cross successive beams and cause their belts to stop.

Articles Ax and Ay will now have reached the start of curves X and Y of FIG. 3. Then as soon as a web synchronisation mark passes beam 21, 24 between the source and the detector the cycle indicated by curves X and Y will commence, the rollers starting up immediately in accordance with the velocity profiles in FIG. 3 while the belt conveyor 18' will start after a short time interval as can be seen from curve Y.

Thereafter as curve X shows, article Ax will be fed out at the constant low conveying speed while the article Ay will end up at the synchronisation position previously occupied by Ax.

While Ax and Ay are being fed forward in this manner, the motor 19'' will be started up as soon as beam 23', 26' between the source and the detector is no longer broken, in this manner the motor 19'' will be started at the same time as motor 19' or later with a time delay in response to a signal from BS1, so as to cause the next article to take the place previously occupied by Ay. Similarly each previous aricle up the accumulation queue will be caused to shift up one station.

Thereafter Ay and successive articles continuously flow through the system, with the cycles previously described being repeated. In practice, once steady state conditions have been reached, transfer of an article from curve Y to curve X will be virtually continuous with the rollers hardly stopping, but decelerating only slightly and to an exent to synchronise with movement of the web 16.

In a practical example of the embodiment described, the two speeds for the rollers were 0.87 and 0.33 meters/sec. Roller 2 had a slightly lower high speed setting to ensure that it decelerated at the same rate as the other rollers (see FIG. 3). The total time period for the graph (i.e. the period of the roller speed cycles) was 600 m. secs, the articles were 16 cm long giving a corresponding distance scale of about 20 cm, and the length of the set of rollers 1 to 7 (centre to centre) was 25 cm. The operating speed of the belt conveyors was 0.87 meters/sec and that of the web was 0.33 meters/-sec corresponding with the high and low speed settings for the roller 1 to 7.

What is claimed is:

1. A device for delivering successive articles to a packaging machine comprising a series of rollers each of which is driven by its own two speed constant acceleration/deceleration motor and arranged so that an article is supported and conveyed jointly by a number of successive rollers as it passes through the device, control means for the control of each roller motor individually to effect a first stage of transport wherein the article is fed into the device at a high speed and taken to a synchronisation position and to effect a second stage of transport wherein the article is fed out of the device at a low speed said control means switching individual rollers from a high speed to a low speed in response to a synchronisation signal from the packaging machine, said conrol means incorporating a timing means which is arranged to control the speeds of the rollers such that after an article is moved out from the synchronisation position at the low speed it can subsequently change the speeds of successive rollers over from the low speed to the high speed at predetermined time intervals after activation of the control means, to thereby enable a subsequent article to be moved into the synchronisation position at the high speed, while the preceding article is still being fed out of the device at the low speed.

2. A device as claimed in claim 1, comprising a series of belt conveyors on which the articles are arranged to be accumulated ready for conveying to said series of rollers.

* * * * *